US011433441B2

(12) United States Patent
Rouns et al.

(10) Patent No.: US 11,433,441 B2
(45) Date of Patent: Sep. 6, 2022

(54) ALUMINUM SHEET WITH ENHANCED FORMABILITY AND AN ALUMINUM CONTAINER MADE FROM ALUMINUM SHEET

(71) Applicant: Kaiser Aluminum Warrick, LLC, Newburgh, IN (US)

(72) Inventors: Thomas N. Rouns, Pittsburgh, PA (US); David J. McNeish, Pittsburgh, PA (US); Jean F. Capps, Pittsburgh, PA (US); Samuel Combs, Pittsburgh, PA (US); Christopher L. Walters, Pittsburgh, PA (US)

(73) Assignee: Kaiser Aluminum Warrick, LLC, Newburgh, IN (US)

( * ) Notice: Subject to any disclaimer, the term of this patent is extended or adjusted under 35 U.S.C. 154(b) by 122 days.

(21) Appl. No.: 15/691,046

(22) Filed: Aug. 30, 2017

(65) Prior Publication Data

US 2018/0056347 A1 Mar. 1, 2018

Related U.S. Application Data

(60) Provisional application No. 62/381,341, filed on Aug. 30, 2016.

(51) Int. Cl.
*C22F 1/047* (2006.01)
*B21B 1/22* (2006.01)
(Continued)

(52) U.S. Cl.
CPC ..... *B21B 1/22* (2013.01); *B21B 3/00* (2013.01); *B21D 37/16* (2013.01); *B21D 51/24* (2013.01);
(Continued)

(58) Field of Classification Search
CPC ..... C22F 1/04–057
See application file for complete search history.

(56) References Cited

U.S. PATENT DOCUMENTS 5,704,240 A 1/1998 Jordan
5,714,019 A 2/1998 Sanders, Jr. et al.
(Continued)

FOREIGN PATENT DOCUMENTS

EP 1870481 A1 12/2007
EP 2997171 B1 3/2016
(Continued)

OTHER PUBLICATIONS

International Search Report and Written Opinion dated Jan. 24, 2018, issued by the Korean Intellectual Property Office in International Application No. PCT/US2017/049873.
(Continued)

*Primary Examiner* — Lois L Zheng
(74) *Attorney, Agent, or Firm* — The Webb Law Firm

(57) ABSTRACT

In some embodiments of the present invention a method includes: obtaining a first aluminum alloy sheet formed from rolling a first ingot of a 3xxx or a 5xxx series aluminum alloy, wherein, prior to rolling, the first ingot has been heated to a sufficient temperature for a sufficient time to achieve a first dispersoid f/r of less than 7.65; and forming a container precursor from the first aluminum alloy sheet, wherein when the first aluminum alloy sheet is formed into the container precursor, the container precursor has less observed surface striations and ridges as compared to a container precursor formed from a second aluminum alloy sheet rolled from a second ingot having a second dispersoid f/r value of 7.65 or greater.

20 Claims, 12 Drawing Sheets

(51) Int. Cl.

| | |
|---|---|
| ***C22F 1/05*** | (2006.01) |
| ***C22C 21/08*** | (2006.01) |
| ***B21B 3/00*** | (2006.01) |
| ***B21D 51/24*** | (2006.01) |
| ***B21D 37/16*** | (2006.01) |
| *C22C 21/06* | (2006.01) |

(52) U.S. Cl.
CPC ..... *C22C 21/08* (2013.01); *C22F 1/05* (2013.01); *B21B 2001/225* (2013.01); *B21B 2003/001* (2013.01)

(56) References Cited

U.S. PATENT DOCUMENTS

| | | | |
|---|---|---|---|
| 5,718,352 | A | 2/1998 | Diekhoff et al. |
| 6,045,632 | A | 4/2000 | Sun et al. |
| 9,663,846 | B2 | 5/2017 | Siles et al. |
| 10,577,683 | B2 | 3/2020 | Vichery et al. |
| 2009/0053099 | A1 | 2/2009 | Kajihara et al. |
| 2010/0159266 | A1 | 6/2010 | Kang et al. |
| 2012/0227871 | A1 | 9/2012 | Inoue et al. |
| 2013/0186905 | A1 | 7/2013 | Lorentzen et al. |
| 2015/0314361 | A1 | 11/2015 | Rouns et al. |

FOREIGN PATENT DOCUMENTS

| | | | |
|---|---|---|---|
| JP | 7126788 | A | 5/1995 |
| JP | 200410941 | A | 1/2004 |
| JP | 2007169744 | A | 7/2007 |
| JP | 2012140664 | A | 7/2012 |
| JP | 2014198879 | A | 10/2014 |
| JP | 2017524530 | A | 8/2017 |
| RU | 2593799 | C2 | 10/2015 |
| WO | 2009/082495 | A1 | 7/2009 |
| WO | 2014156907 | A1 | 10/2014 |
| WO | 2014184450 | A1 | 11/2014 |

OTHER PUBLICATIONS

Advice of Despatch to Rexam Beverage Can, No. 20333564, Novelis Deutschland Gmbh, Sep. 27, 2013.

Advice of Despatch to Rexam Beverage Can, No. 20333565, Novelis Deutschland Gmbh, Sep. 27, 2013.

Advice of Despatch to Rexam Beverage Can, No. 20334061, Novelis Deutschland Gmbh, Sep. 30, 2013.

Constellium Neuf Brisach Previous Public Use, 2011.

Constellium Activity Report, Constellium, 2012.

Czech Point, The CanMaker, Sayers Publishing Group, Jul. 2012, pp. 39-43.

I.C. Kammer, Aluminum Handbook, vol. 1 Fundamentals and Materials, First Edition, 1999, pp. 238-245.

Invoice and Coils to Rexam Beverage Can Europe Ltd., Novelis Geutschland Gmbh, Sep. 30, 2013.

Mechanical Properties of Metals and Metal Alloys, http://www.engineering-abc.com (no information available).

The Aluminum Association, Inc., "International Alloy Designations and Chemical Composition Limits for Wrought Aluminum and Wrought Aluminum Alloys", Jan. 2015, pp. 1-38.

Example BSE Photomicrographs for 17 Hour Preheat
(Mn, Mg values in wt. %)

Example BSE Photomicrographs for 55 Hour Preheat
(Mn, Mg values in wt. %)

Redrawn (Secondary) Cup Surface Appearance: Alloy 1

Redrawn (Secondary) Cup Surface Appearance

Redrawn (Secondary) Cup Surface Appearance

Alloy 2, Long Preheat 55hrs

Alloy 2, Conventional Preheat 17hrs

ALUMINUM SHEET WITH ENHANCED FORMABILITY AND AN ALUMINUM CONTAINER MADE FROM ALUMINUM SHEET

CROSS-REFERENCE TO RELATED APPLICATIONS

This application claims benefit of U.S. provisional application No. 62/381,341, filed Aug. 30, 2016, which is herein incorporated by reference in its entirety.

FIELD OF THE INVENTION

Broadly, the invention relates to systems and methods of forming articles, such as beverage containers.

BACKGROUND

In the container industry, substantially identically shaped metal beverage containers are produced massively and relatively economically. In order to expand a diameter of a container to create a shaped container or enlarge the diameter of the entire container, often several operations are required using several different expansion dies to expand each metal container a desired amount. Also, dies have been used to neck and shape containers. Often several operations are required using several different dies to expand and/or narrow each metal container a desired amount. A blank is formed into a cup having a closed bottom on one end and an open end on the other end of the container. Then the cup is converted/formed into a can via a bodymaker (e.g. redrawing and ironing steps). Open ends of containers are finished by flanging, curling, threading and/or other operations to accept closures such as a crown, twist-off crown, ROPP closure, cap, and seamed end. Necking, expanding, shaping, and finishing operations sometimes cause container failures, such as one or more of the following: curl splits, container fracture, container collapse, wrinkles, puckers, thread fracture, thread collapse, split flanges.

SUMMARY

A method, comprising: obtaining a first aluminum alloy sheet formed from rolling a first ingot of a 3xxx or a 5xxx series aluminum alloy, wherein, prior to rolling, the first ingot has been heated to a sufficient temperature for a sufficient time to achieve a first dispersoid f/r of less than 7.65; and forming a container precursor from the first aluminum alloy sheet, wherein when the first aluminum alloy sheet is formed into the container precursor, the container precursor has less observed surface striations and ridges as compared to a container precursor formed from a second aluminum alloy sheet rolled from a second ingot having a second dispersoid f/r value of 7.65 or greater.

In some embodiments, the first aluminum alloy sheet has a thickness between 0.006 inches to not greater than 0.07 inches.

In some embodiments, the 3xxx series aluminum alloy is selected from the group consisting of: AA 3x03, AA 3x04 and AA 3x05.

In some embodiments, the 3xxx series aluminum alloy is AA 3104.

In some embodiments, 5xxx series aluminum alloy sheet is selected from the group consisting of AA 5043 and AA 5006.

In some embodiments, the first dispersoid f/r is between about 4.5 to less than 7.65.

In some embodiments, an amount of Mn in the first aluminum alloy sheet is from 0.45 wt. % to not greater than 0.95 wt. % Mn.

In some embodiments, an amount of Mg in the first aluminum alloy sheet is from 0.5 wt. % to not greater than 0.9 wt. % Mg.

A method comprising: heating a first ingot of 3xxx or 5xxx series aluminum alloy to a sufficient temperature for a sufficient time to achieve a first dispersoid f/r of less than 7.65; and rolling the first ingot into a first aluminum alloy sheet; wherein when the first aluminum alloy sheet is formed into a container precursor, the container precursor has less observed surface striations and ridges as compared to a container precursor formed from a second aluminum alloy sheet rolled from a second ingot having a second dispersoid f/r value of 7.65 or greater.

In some embodiments, the first aluminum alloy sheet has a thickness between 0.006 inches to not greater than 0.07 inches.

In some embodiments, the 3xxx series aluminum alloy is selected from the group consisting of: AA 3x03, AA 3x04 and AA 3x05.

In some embodiments, the 3xxx series aluminum alloy is AA 3104.

In some embodiments, the 5xxx series aluminum alloy sheet is selected from the group consisting of AA 5043 and AA 5006.

In some embodiments, the first dispersoid f/r is between about 4.5 to less than 7.65.

In some embodiments, an amount of Mn in the aluminum alloy sheet is from 0.45 wt. % to not greater than 0.95 wt. % Mn.

In some embodiments, an amount of Mg in the first aluminum alloy sheet is from 0.5 wt. % to not greater than 0.9 wt. % Mg.

A method, comprising: obtaining a first aluminum alloy sheet formed from rolling a first ingot of a 3xxx or a 5xxx series aluminum alloy, wherein, prior to rolling, the first ingot has been heated to a sufficient temperature for a sufficient time to achieve a first dispersoid f/r of less than 7.65; and forming a container from the first aluminum alloy sheet, wherein when the first aluminum alloy sheet is formed into the container, the container does not have at least one container failure as compared to a container formed from a second aluminum alloy sheet rolled from a second ingot having a second dispersoid f/r value of 7.65 or greater.

In some embodiments, the first aluminum alloy sheet has a thickness between 0.006 inches to not greater than 0.07 inches.

A method comprising: heating a first ingot of 3xxx or 5xxx series aluminum alloy to a sufficient temperature for a sufficient time to achieve a first dispersoid f/r of less than 7.65; and rolling the first ingot into a first aluminum alloy sheet; wherein when the first aluminum alloy sheet is formed into a container, the container has does not have at least one container failure as compared to a container formed from a second aluminum alloy sheet rolled from a second ingot having a second dispersoid f/r value of 7.65 or greater.

In some embodiments, the first aluminum alloy sheet has a thickness between 0.006 inches to not greater than 0.07 inches.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
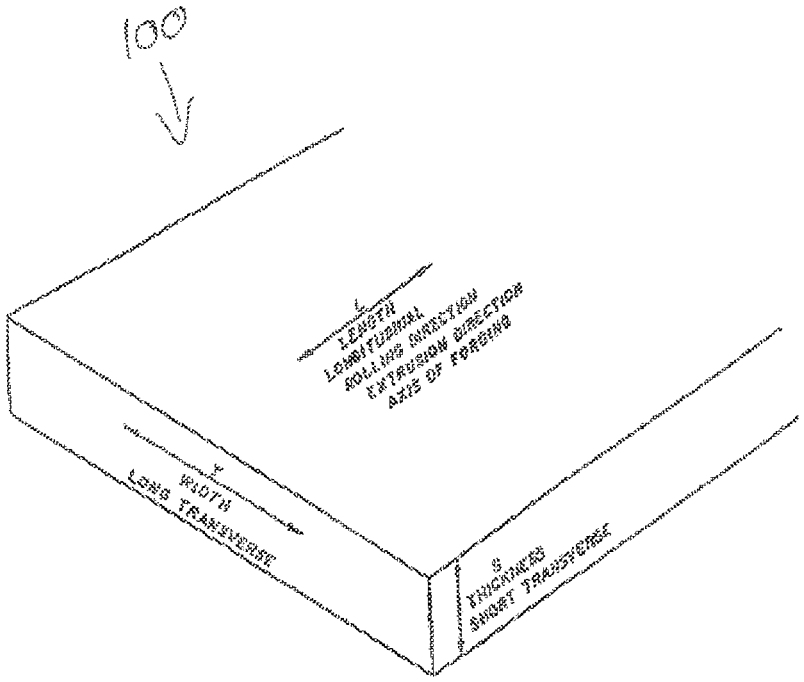
FIG. 1 depicts a partial enlarged perspective view of an aluminum sheet in accordance with some embodiments of the present disclosure.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

The term "based on" is not exclusive and allows for being based on additional factors not described, unless the context clearly dictates otherwise. In addition, throughout the specification, the meaning of "a," "an," and "the" include plural references. The meaning of "in" includes "in" and "on".

Figure 11:
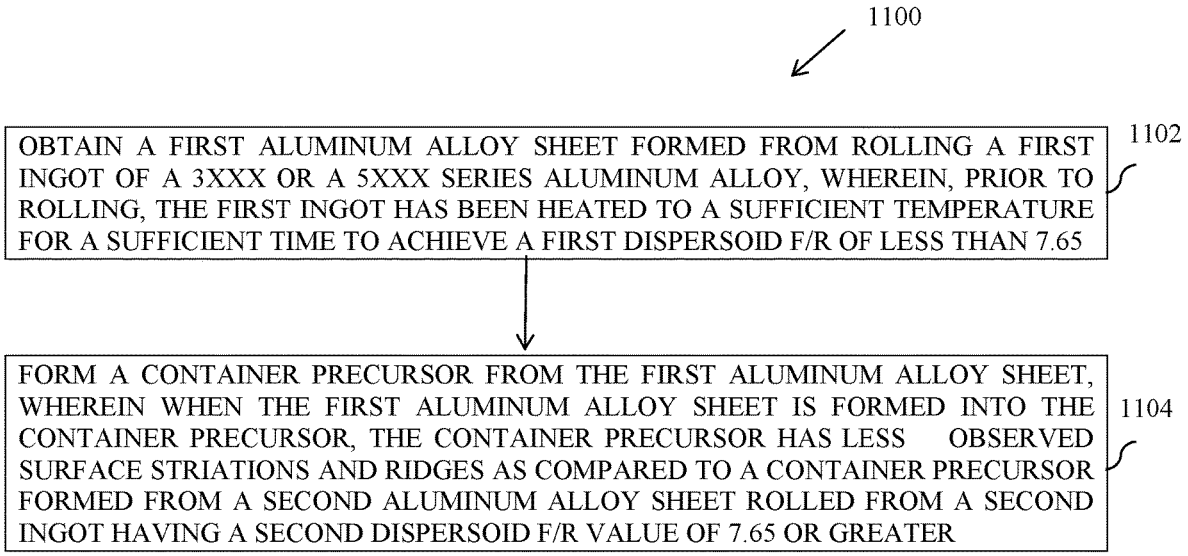
FIG. 11 depicts a flow chart of an exemplary method in accordance with some embodiments of the present disclosure.

FIG. 11 depicts a flow chart of an exemplary method 1100 in accordance with some embodiments of the present disclosure. The method 1100 comprises, at 1102, obtaining a first aluminum alloy sheet formed from rolling a first ingot of a 3xxx or a 5xxx series aluminum alloy. Prior to rolling, the first ingot has been heated to a sufficient temperature for a sufficient time to achieve a first dispersoid f/r of less than 7.65. Next at 1104, the method 1100 comprises forming a container precursor from the first aluminum alloy sheet, wherein when the first aluminum alloy sheet is formed into the container precursor, the container precursor has less observed surface striations and ridges as compared to a container precursor formed from a second aluminum alloy sheet rolled from a second ingot having a second dispersoid f/r value of 7.65 or greater.

Figure 12:
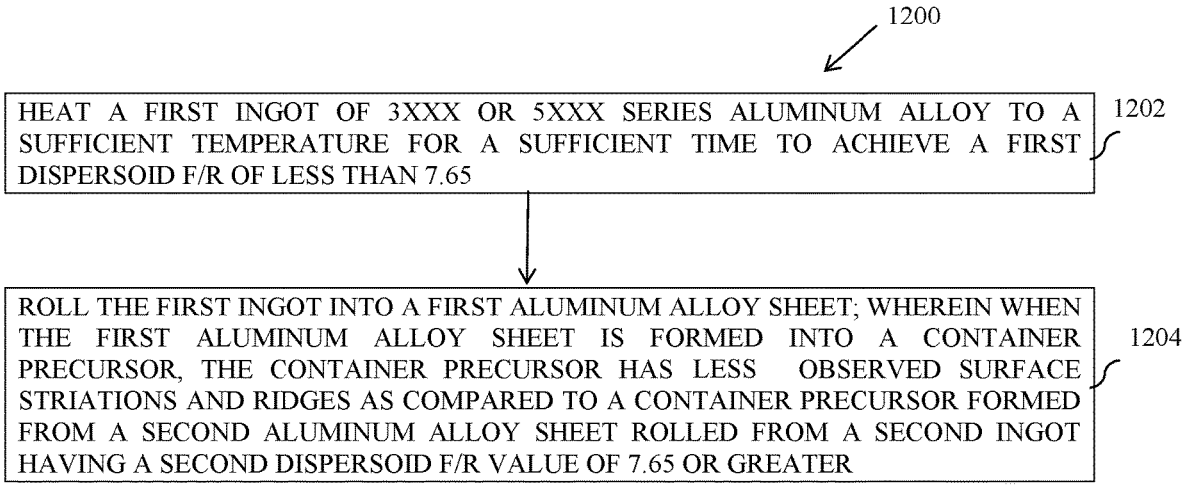
FIG. 12 depicts a flow chart of an exemplary method in accordance with some embodiments of the present disclosure.

FIG. 12 depicts a flow chart of an exemplary method 1200 in accordance with some embodiments of the present disclosure. The method 1200 comprises, at 1202, heating a first ingot of 3xxx or 5xxx series aluminum alloy to a sufficient temperature for a sufficient time to achieve a first dispersoid f/r of less than 7.65. Next at 1204 the method comprises rolling the first ingot into a first aluminum alloy sheet; wherein when the first aluminum alloy sheet is formed into a container precursor, the container precursor has less observed surface striations and ridges as compared to a container precursor formed from a second aluminum alloy sheet rolled from a second ingot having a second dispersoid f/r value of 7.65 or greater As used herein, "container precursor" refers to a cup or a cup that has been redrawn one or more times. In some embodiments, the cup is configured with a bottom and a perimetrical sidewall that extends upward circumferentially from the perimeter of the bottom of the cup. In some embodiments, the cup is one-piece with a closed end (bottom) and an open upper end. In some embodiments, additional forming steps may be performed on the cup (e.g. bottom and/or sidewalls) in order to form an aluminum container configured with a flat or dome bottom.

In some embodiments, the aluminum alloy sheet 100, as depicted in FIG. 1, comprises an AA 3xxx or a 5xxx alloy having a dispersoid f/r value of less than 7.65. In some embodiments, the aluminum alloy sheet comprises one of AA: 3x03, 3x04 or 3x05. In some embodiments, the aluminum alloy is selected from the group consisting of: AA 3x03, AA3x04 and AA 3x05. In some embodiments, the aluminum alloy sheet comprises AA 3104. In some embodiments, the aluminum alloy sheet is selected from the group consisting of AA 5043 and AA 5006. In some embodiments, the aluminum alloy sheet is rolled aluminum alloy sheet.

In some embodiments, the aluminum alloy sheet has a thickness ranging from 0.006 inch to not greater than 0.07 inch. In some embodiments, the aluminum alloy sheet has a thickness ranging from 0.006 inch to not greater than 0.06 inch. In some embodiments, the aluminum alloy sheet has a thickness ranging from 0.006 inch to not greater than 0.05 inch. In some embodiments, the aluminum alloy sheet has a thickness ranging from 0.006 inch to not greater than 0.04 inch. In some embodiments, the aluminum alloy sheet has a thickness ranging from 0.006 inch to not greater than 0.03 inch. In some embodiments, the aluminum alloy sheet has a thickness ranging from 0.006 inch to not greater than 0.02 inch. In some embodiments, the aluminum alloy sheet has a thickness ranging from 0.006 inch to not greater than 0.01 inch.

In some embodiments, the aluminum alloy sheet has a thickness ranging from 0.01 inch to not greater than 0.07 inch. In some embodiments, the aluminum alloy sheet has a thickness ranging from 0.012 inch to not greater than 0.07 inch. In some embodiments, the aluminum alloy sheet has a thickness ranging from 0.014 inch to not greater than 0.07 inch. In some embodiments, the aluminum alloy sheet has a thickness ranging from 0.016 inch to not greater than 0.07 inch. In some embodiments, the aluminum alloy sheet has a thickness ranging from 0.018 inch to not greater than 0.07 inch. In some embodiments, the aluminum alloy sheet has a thickness ranging from 0.02 inch to not greater than 0.07 inch.

In some embodiments, a 3xxx or 5xxx series aluminum alloy sheet is formed from a suitable ingot. The ingot undergoes a preheat practice for a sufficient time and at a sufficient temperature to have a dispersoid f/r value of less than 7.65. The preheat practice refers to the pre-soak time of the ingot at a suitable temperature plus the soak time of the ingot at a suitable temperature.

In some embodiments, the dispersoid f/r value is: less than 7.65. In some embodiments, the dispersoid f/r value is: less than 7.5; less than 7; less than 6.5; less than 6; less than 5.5; less than 5; less than 4.5; less than 4; less than 3.5; less than 3; less than 2.5; less than 2; less than 1.5; less than 1; or lower.

In some embodiments, at least some dispersoids are present in the aluminum alloy sheet.

In some embodiments, the dispersoid f/r values described above are for an ingot processed to form an aluminum alloy sheet shipped as aluminum sheet coil to an aluminum container maker (e.g. a maker of aluminum cans and/or aluminum bottles).

As used herein, "dispersoid" means: second phase particles that form during the preheat practice of the ingot. For example, dispersoids are a Mn-containing phase in either 3xxx or 5xxx series aluminum alloys.

As used herein, "dispersoid f/r" means the ratio of the amount of the second phase divided by the size of the second phase.

In some embodiments, a 3xxx or 5xxx aluminum alloy sheet having a Mn content of 0.4 wt. % to 0.95 wt. % and a Mg content of 0.5 wt. % to 0.9 wt. % will have a dispersoid f/r value of less than 7.65.

In some embodiments, a 3xxx or 5xxx aluminum alloy sheet having a Mn content of 0.4 wt. % to 0.95 wt. % and a Mg content of 0.5 wt. % to 0.9 wt. % is formed from an ingot having undergone preheat practice for a sufficient time at a sufficient temperature to obtain a dispersoid f/r value of less than 7.65.

In some embodiments, the Mn content is: at least 0.45 wt. % Mn; at least 0.5 wt. % Mn; at least 0.55 wt. % Mn; at least 0.60 wt. % Mn; at least 0.65 wt. % Mn; at least 0.70 wt. % Mn; at least 0.75 wt. % Mn; at least 0.8 wt. % Mn; at least 0.85 wt. % Mn; at least 0.9 wt. % Mn; or at least 0.95 wt. % Mn.

In some embodiments, the Mn content is: not greater than 0.45 wt. % Mn; not greater than 0.5 wt. % Mn; not greater than 0.55 wt. % Mn; not greater than 0.60 wt. % Mn; not greater than 0.65 wt. % Mn; not greater than 0.70 wt. % Mn; not greater than 0.75 wt. % Mn; not greater than 0.8 wt. % Mn; not greater than 0.85 wt. % Mn; not greater than 0.9 wt. % Mn; or not greater than 0.95 wt. % Mn.

In some embodiments, the Mg content is: at least 0.5 wt. % Mg; at least 0.55 wt. % Mg; at least 0.60 wt. % Mg; at least 0.65 wt. % Mg; at least 0.70 wt. % Mg; at least 0.75 wt. % Mg; at least 0.8 wt. % Mg; at least 0.85 wt. % Mg; or at least 0.9 wt. % Mg.

In some embodiments, the Mg content is: not greater than 0.5 wt. % Mg; not greater than 0.55 wt. % Mg; not greater than 0.60 wt. % Mg; not greater than 0.65 wt. % Mg; not greater than 0.70 wt. % Mg; not greater than 0.75 wt. % Mg; not greater than 0.8 wt. % Mg; not greater than 0.85 wt. % Mg; or not greater than 0.9 wt. % Mg.

Figure 3:
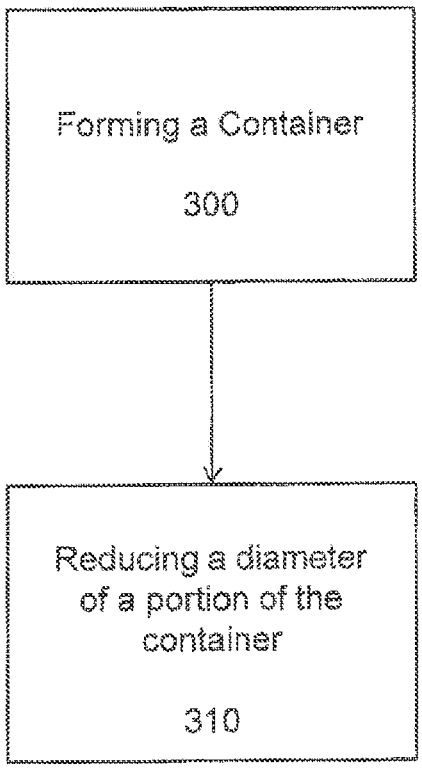
FIG. 3 depicts process steps in accordance with some embodiments of the present disclosure.

In some embodiments, as depicted in FIG. 3, the methods 1100, 1200 described above further comprise, at 300, forming a container from the container precursor; and, at 310, reducing a diameter of a portion of the container by at least 26% (e.g. to form a tapered neck consistent with an aluminum bottle configuration).

In some embodiments, reducing a diameter of the container comprises necking the container with necking dies (i.e. through multiple progressions). In some embodiments, the methods 1100, 1200 further comprise expanding a section of the portion of the container having a reduced diameter. In some embodiments, the section has a length. In some embodiments, the length is at least 0.3 inches. In some embodiments, the length is at least 0.4 inches. In some embodiments, the methods 1100, 1200 further comprise expanding a necked section of the portion of the container having a reduced diameter. In some embodiments, a container is a bottle. In one embodiment, a bottle is a rigid container having a neck diameter that is smaller than the diameter of the body. In some embodiments, the container is resealable.

Figure 2:
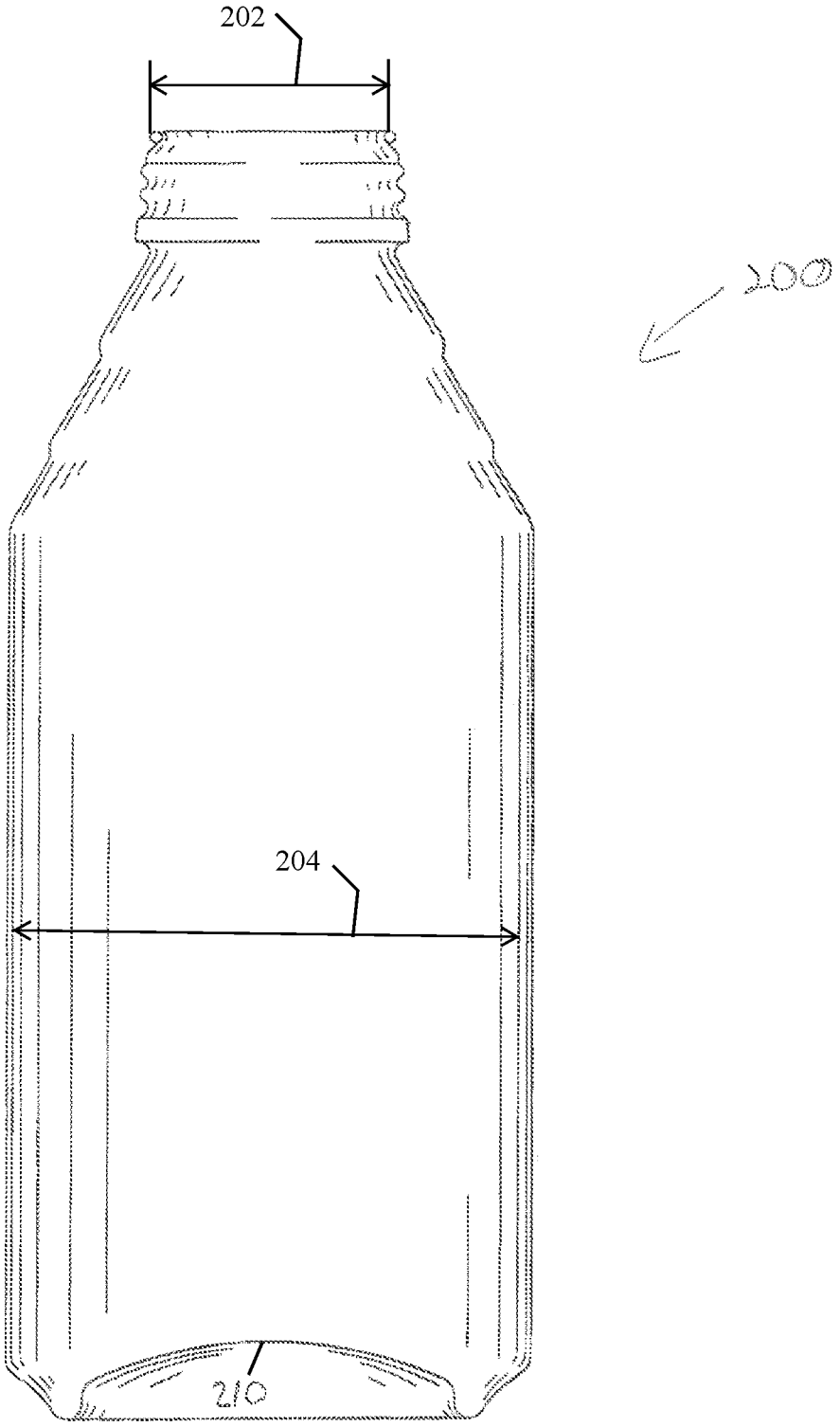
FIG. 2 depicts a side view of an aluminum bottle having an integral dome in accordance with some embodiments of the present disclosure.

FIG. 2 depicts an exemplary aluminum container (e.g. aluminum bottle) 200 having a dome 210 formed in accordance with some embodiments of the present disclosure. In some embodiments, a dome 210 is the dome 210 at the bottom of the aluminum container 200. In some embodiments, the aluminum container 200 comprises an AA 3xxx or a 5xxx alloy having a dispersoid f/r value of less than 7.65. In some embodiments, the aluminum container 200 may have a first diameter 202 and a second diameter 204. In some embodiments, the first diameter 202 is the minimum diameter of the aluminum container 200, excluding the dome 210. In some embodiments, the second diameter 204 is the maximum diameter of the aluminum container 200. In some embodiments, the first diameter 202 is at a first end of the aluminum container 200 opposite the dome 210. In some embodiments, the second diameter 204 is between the first end and the dome 210. In some embodiments, the first diameter 202 is less than 70% of the second diameter 204. In some embodiments, the first diameter 202 is less than 65% of the second diameter 204. In some embodiments, the first diameter 202 is less than 60% of the second diameter 204. In some embodiments, the first diameter 202 is less than 55% of the second diameter 204.

In some embodiments, the aluminum container 200 comprises one of AA: 3x03, 3x04 or 3x05. In some embodiments, the aluminum container 200 comprises AA 3104. In some embodiments, the aluminum container 200 is selected from the group consisting of AA 5043 and 5006. In some embodiments, the aluminum container 200 has been formed by drawing and ironing an aluminum sheet.

The alloys and tempers mentioned herein are as defined by the American National Standard Alloy and Temper Designation System for Aluminum ANSI H35.1 and "the Aluminum Association International Alloy Designations and Chemical Composition Limits for Wrought Aluminum and Wrought Aluminum Alloys as revised February 2009.

EXAMPLE

Formability Evaluation

The formability of aluminum sheet alloy was evaluated by forming container precursors (e.g. cups) out of 3xxx or 5xxx series aluminum alloy sheet with a thickness of 0.0186 inches and having a dispersoid f/r value of 7.65 or greater and comparing to cups formed with aluminum alloy sheet having a dispersoid f/r of less than 7.65.

Visual observations of the cup surface appearance were completed. In one or more embodiments, improved cup formation can be quantified/evaluated by one or more criterion, including characteristics indicative of forming failures or defects, which would reject the cup or likely create downstream forming problems for necking, curling, threading, flanging, or expansion operations.

Contrast in the formability characteristics evaluated via visual observations were readily apparent in the cups formed from both 3xxx series aluminum and 5xxx series aluminum having dispersoid f/r values of 7.65 or greater as compared to those cups formed from 3xxx or 5xxx series aluminum alloy sheet having dispersoid f/r values of less than 7.65.

It was observed (and shown in FIGS. 7-10) that the longer preheat resulted in a visually smoother appearance of the cup in all evaluated instances. Thus, it is concluded that the longer preheat practice makes an aluminum alloy sheet with improved formability, i.e. forms a better/improved redrawn cup as opposed to a cup without a longer preheat practice. A better cup makes a better aluminum container (i.e. less reject rates and/or defects) with additional downstream forming operations.

In a commercial bottle line, these cups would proceed to further forming steps including one or more of the following finishing steps: converting a cup to a can (via a bodymaker), necking, expanding, forming threads, narrowing, curling, flanging, or forming the opening of the container to accept a closure. The observed surface striations and ridges on the cups from sheet having a dispersoid f/r value of 7.65 or higher, are believed to have a high reject rate in a commercial bottle line (as compared to cups without such surface characteristics/defects having a dispersoid f/r values of less than 7.65), with successive forming operations. Rejection can be caused by container failures, such as one or more of the following: curl splits, container fracture, container collapse, wrinkles, puckers, thread fracture, thread collapse, split flanges, or surface finish, among others.

EXAMPLE

Composition and Preheat Impact on Dispersoid f/r

In order to evaluate the composition and/or preheat practice impact on aluminum sheet, three different alloys were evaluated in comparison with a control, a commercially available bottlestock alloy.

Figure 5:
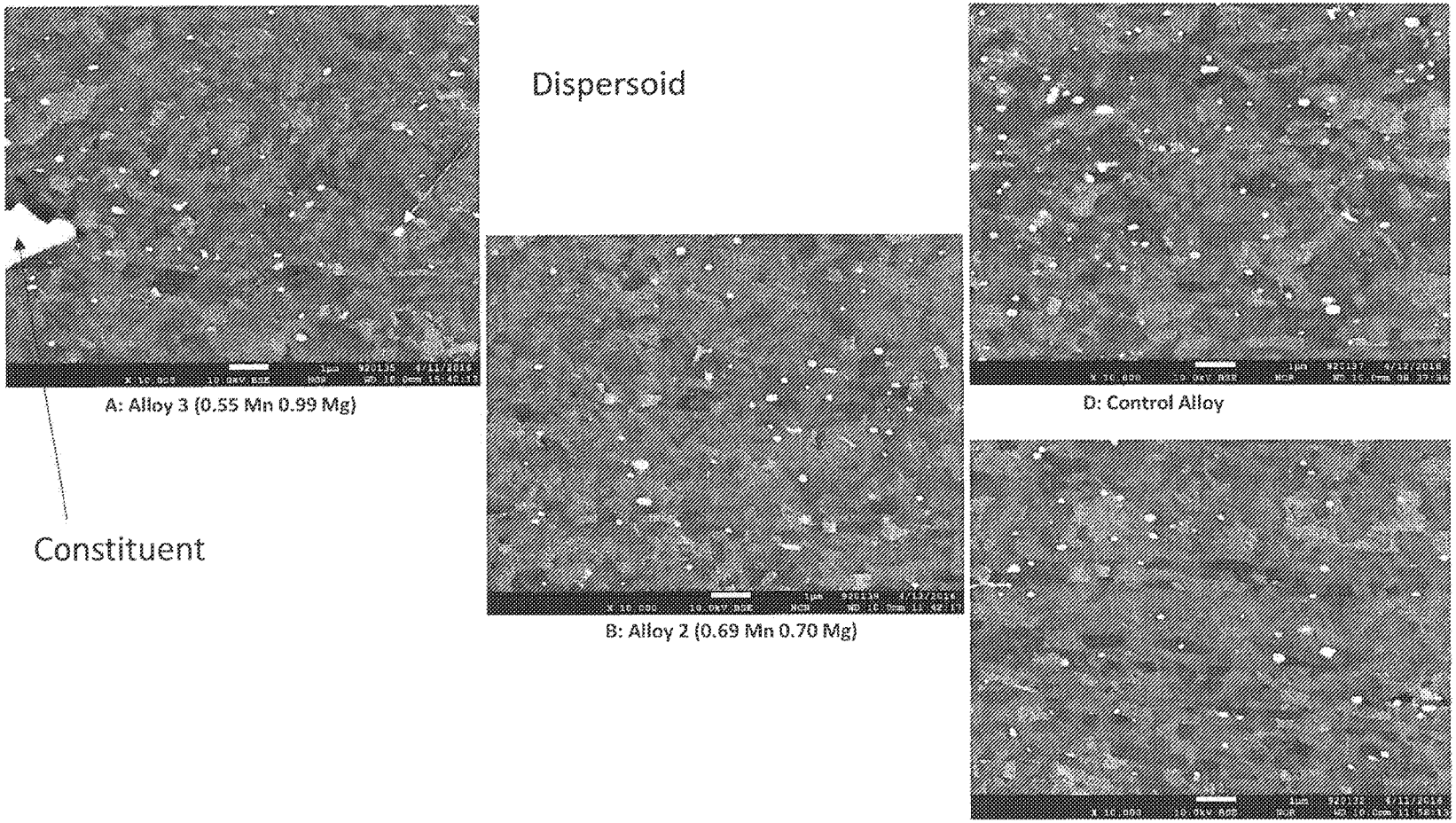
FIG. 5 depicts example Backscatter Electron (BSE) Photomicrographs for 17 Hour Preheat for Alloys 1-3 and the control for the Example in accordance with some embodiments of the present disclosure.
Figure 6:
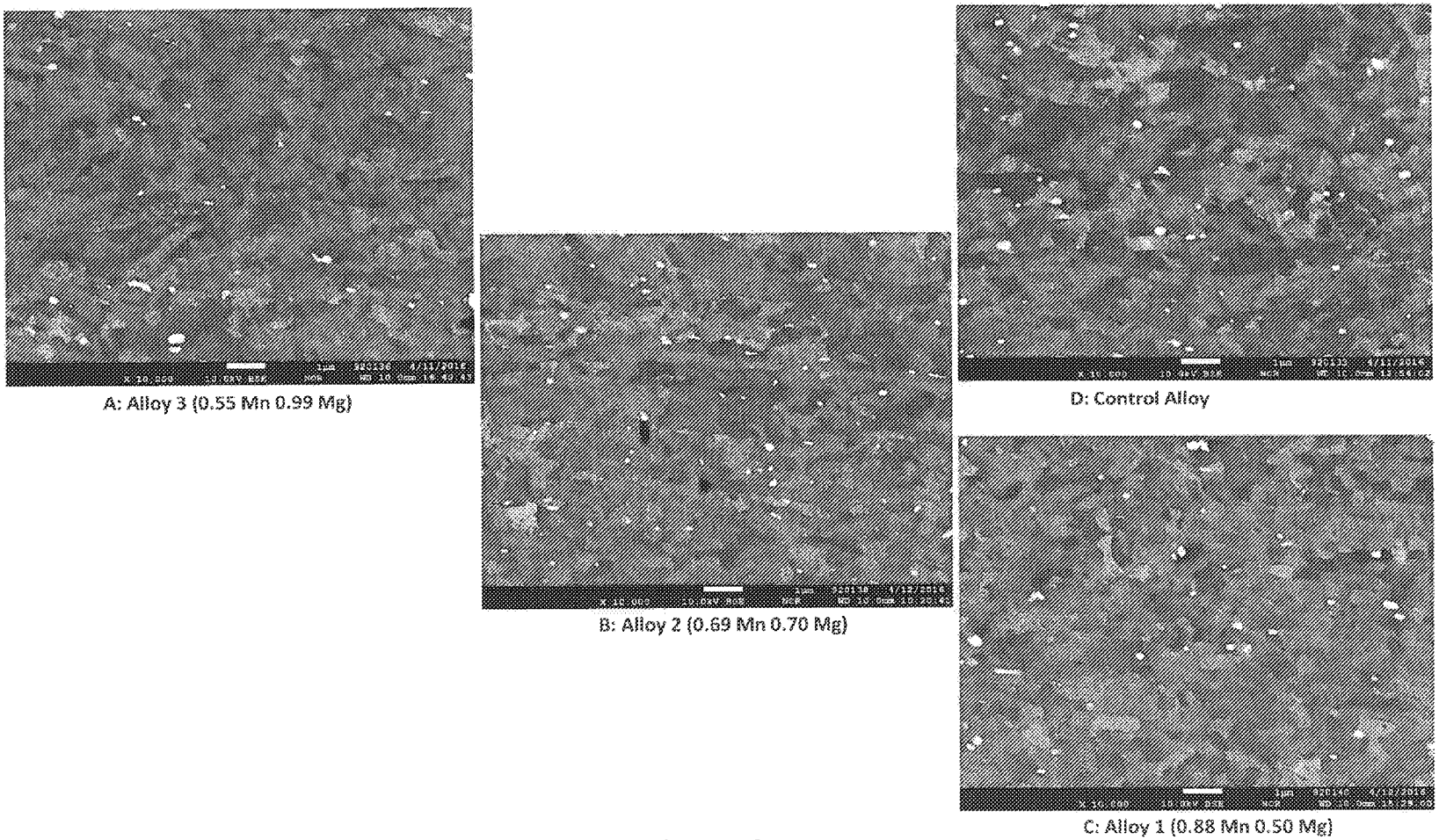
FIG. 6 depicts example Backscatter Electron (BSE) Photomicrographs for 55 hour Preheat for Alloys 1-3 and the control for the Example in accordance with some embodiments of the present disclosure.
Figure 7:
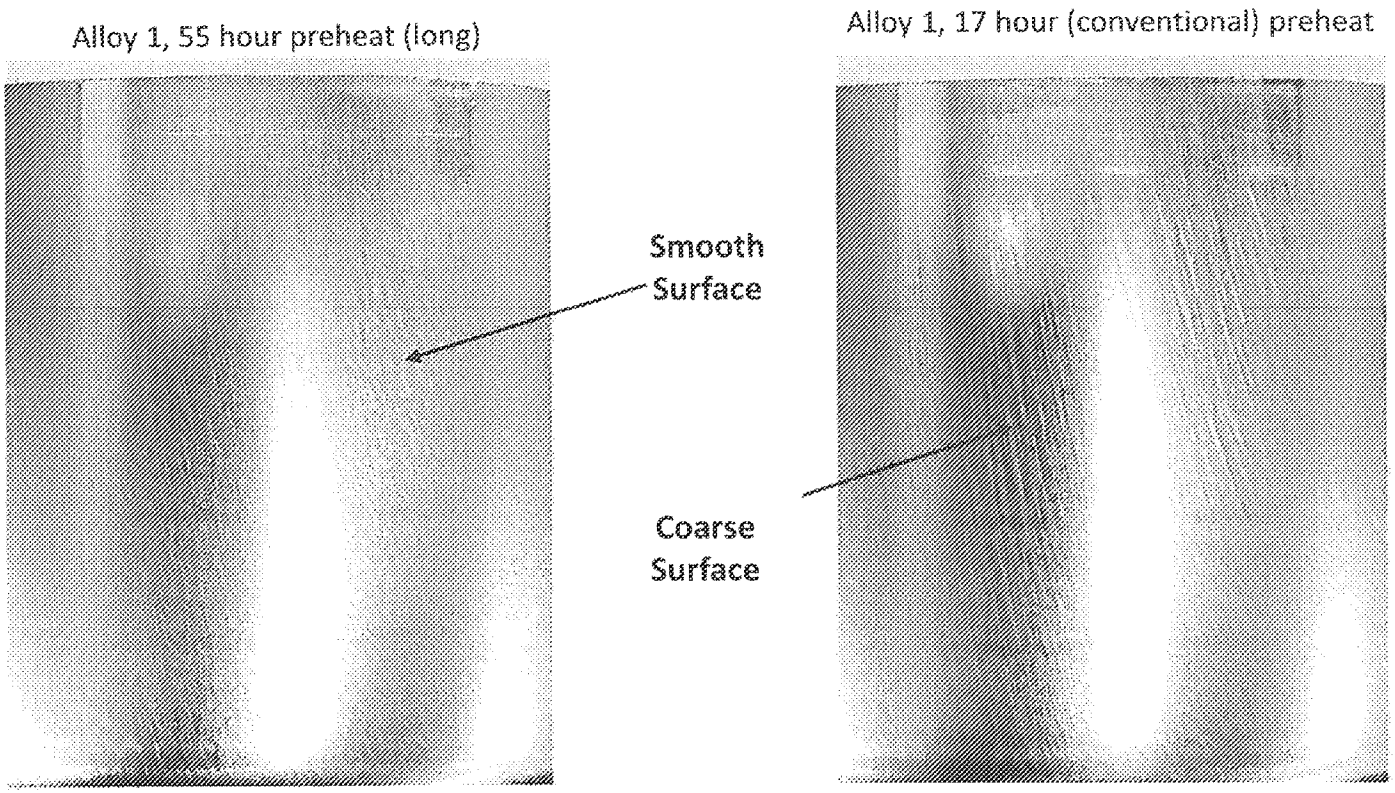
FIG. 7 provides comparative photographs for redrawn (secondary) cup surface appearance for Alloy 1 at conventional and long preheats in accordance with some embodiments of the present disclosure.
Figure 8:
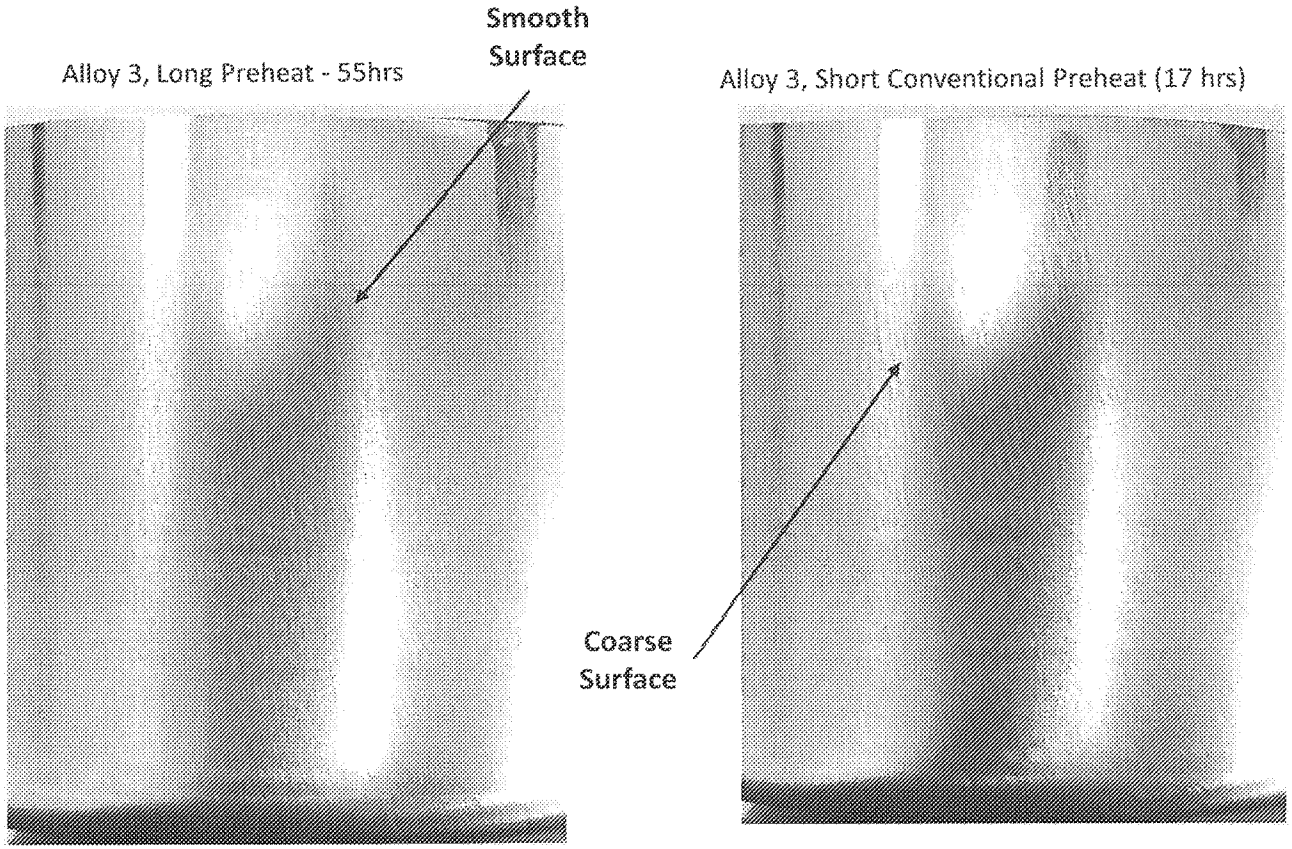
FIG. 8 provides comparative photographs for redrawn (secondary) cup surface appearance for Alloy 3 at conventional and long preheats in accordance with some embodiments of the present disclosure.
Figure 9:
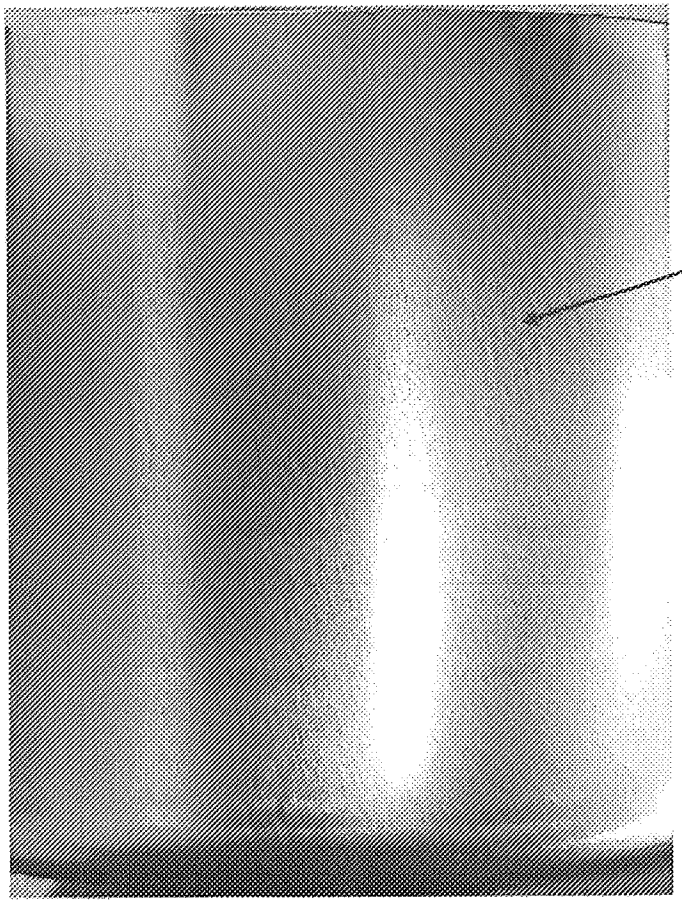
FIG. 9 provides comparative photographs for redrawn (secondary) cup surface appearance for Alloy 2 at conventional and long preheats in accordance with some embodiments of the present disclosure.
Figure 9:
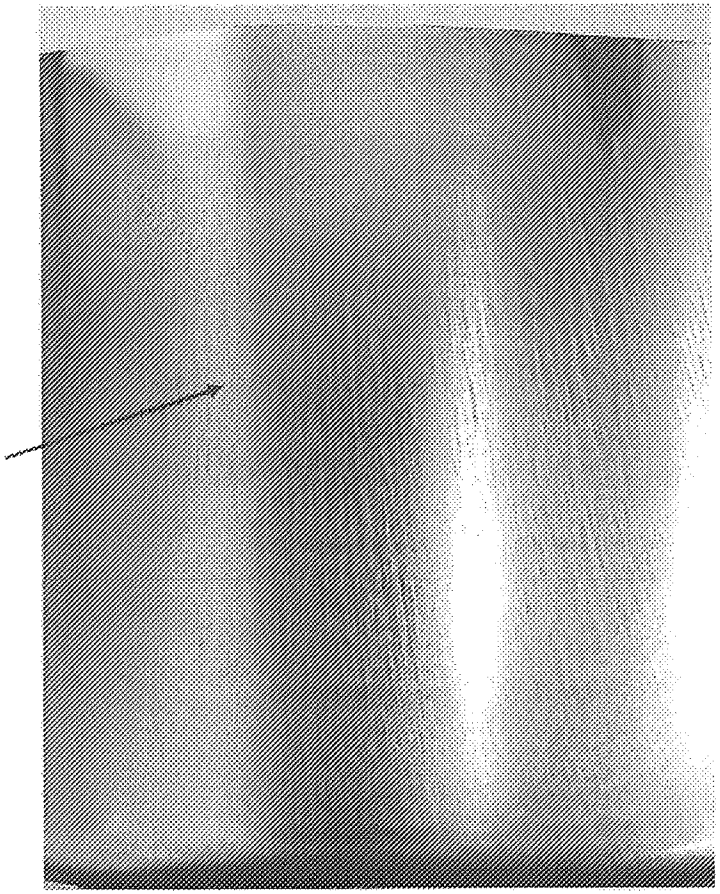
Figure 10:
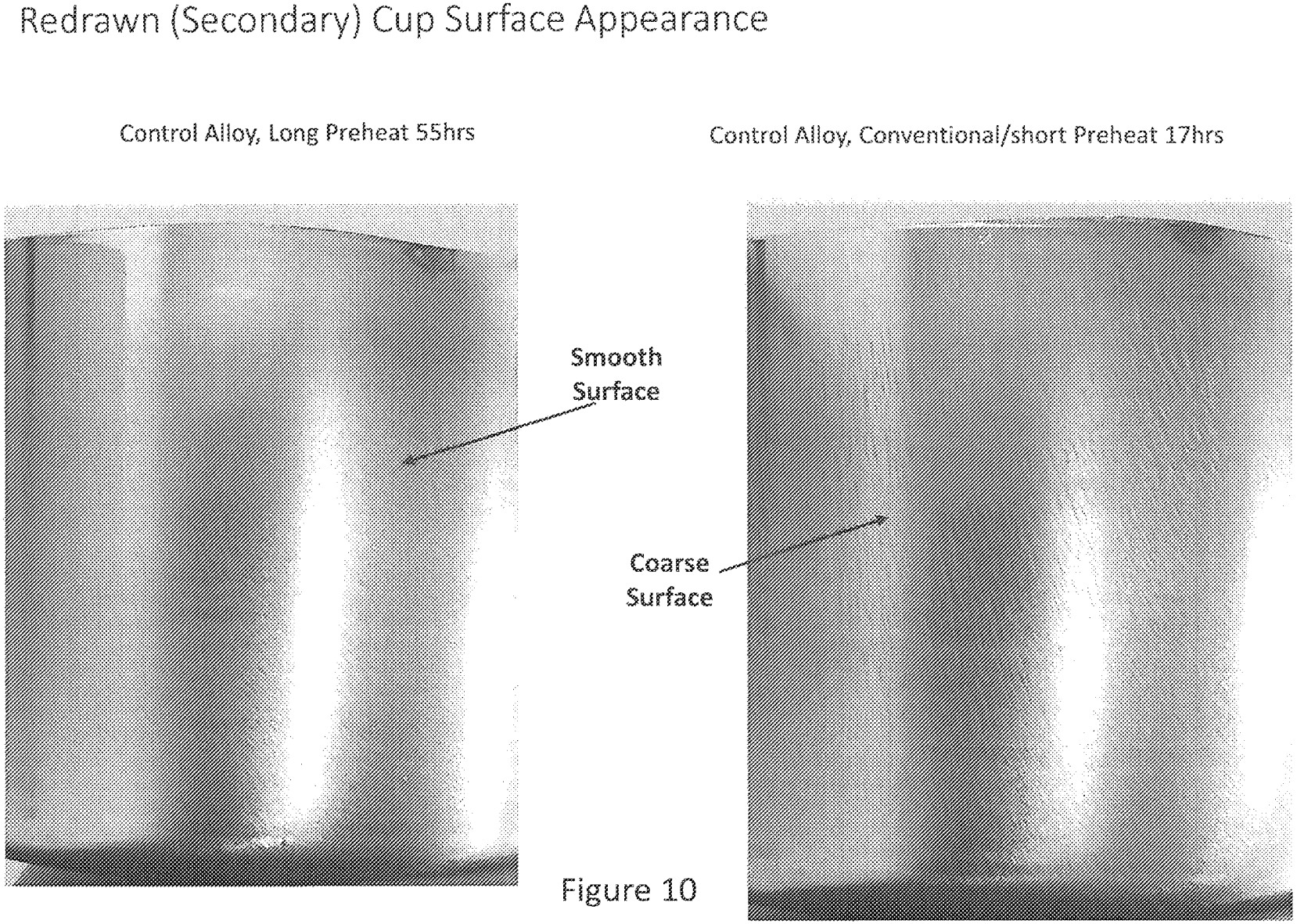
FIG. 10 provides comparative photographs for redrawn (secondary) cup surface appearance for the Control Alloy at conventional and long preheats in accordance with some embodiments of the present disclosure.

Quantitative Microstructure Characterization (e.g. Dispersoid f/r calculation) was completed on the sheet. On the samples, SEM images were collected with backscattered electron images (15 images) at 3 thickness locations on a metallographically prepared longitudinal section at a magnification of 10 k×. FIG. 5 depicts example Backscatter Electron (BSE) Photomicrographs for 17 Hour Preheat for Alloys 1-3 in comparison to the Control Alloy in accordance with some embodiments of the present disclosure. FIG. 6 depicts example Backscatter Electron (BSE) Photomicrographs for 55 hour Preheat for Alloys 1-3 in comparison to the Control Alloy in accordance with some embodiments of the present disclosure.

It is noted that locations that have a heavier average atomic number will appear brighter in the BSE image—$Al_{12}[Fe,Mn]_3Si$ insoluble constituents and $Al_{12}Mn_3Si$ dispersoids will be bright relative to the aluminum matrix. The resulting images were assessed with image analysis to measure all particles <550 nm (0.55 μm) in diameter.

Dispersoids are identified and utilized in order to quantify the dispersoid f/r value. Digital images are collected via SEM and 15 images at the surface, 15 images at t/4 (quarter plane) and 15 images at t/2 (half plane). The grey level images have a two level discrimination performed on the image, and all particles over a predetermined threshold size [submicron sized particle upper limit] are discarded (constituents), thus defining the dispersoids (particles<predetermined threshold) in a particular location of the ingot.

Once particles are measured, they are binned/grouped as a function of cross sectional area. In log space, 5 bins per decade, sum areas of the dispersoids in each bin and divide by total area that was measured then multiply by 100 to provide area % of the dispersoids ("f" value). To determine 'r' value, take the upper bin limit equal to the area of a circle ($\pi r^2$) and solve for r. Then dispersoid f/r is calculated for individual bins, and then dispersoid f/r is summed to obtain dispersoid f/r value for a particular alloy sample (e.g. Alloy 1-3 and the Control Alloy).

In order to evaluate/determine the impact of preheat practice (conventional and long) on the microstructure, mechanical properties, and formability, three alloys were evaluated and compared to a Control Alloy.

The table below quantifies the dispersoid ($Al_{12}Mn_3Si$) differences by alloy and preheat using SEM images and quantitative metallography.

| | 17 hour preheat | | | | 55 hour preheat | | | |
|---|---|---|---|---|---|---|---|---|
| | area % | d (nm) | number density (#/unit area) | Dis-persoid f/r | area % | d (nm) | number density (#/unit area) | Dis-persoid f/r |
| Alloy 1 | 0.60 | 125 | 3.81 | 9.57 | 0.34 | 135 | 1.87 | 5.01 |
| Alloy 2 | 0.63 | 120 | 4.53 | 10.50 | 0.46 | 130 | 2.58 | 7.14 |
| Alloy 3 | 0.56 | 121 | 3.89 | 9.28 | 0.31 | 129 | 1.67 | 4.85 |
| Control | 0.89 | 129 | 5.55 | 13.8 | 0.62 | 138 | 2.73 | 7.65 |

Figure 4:
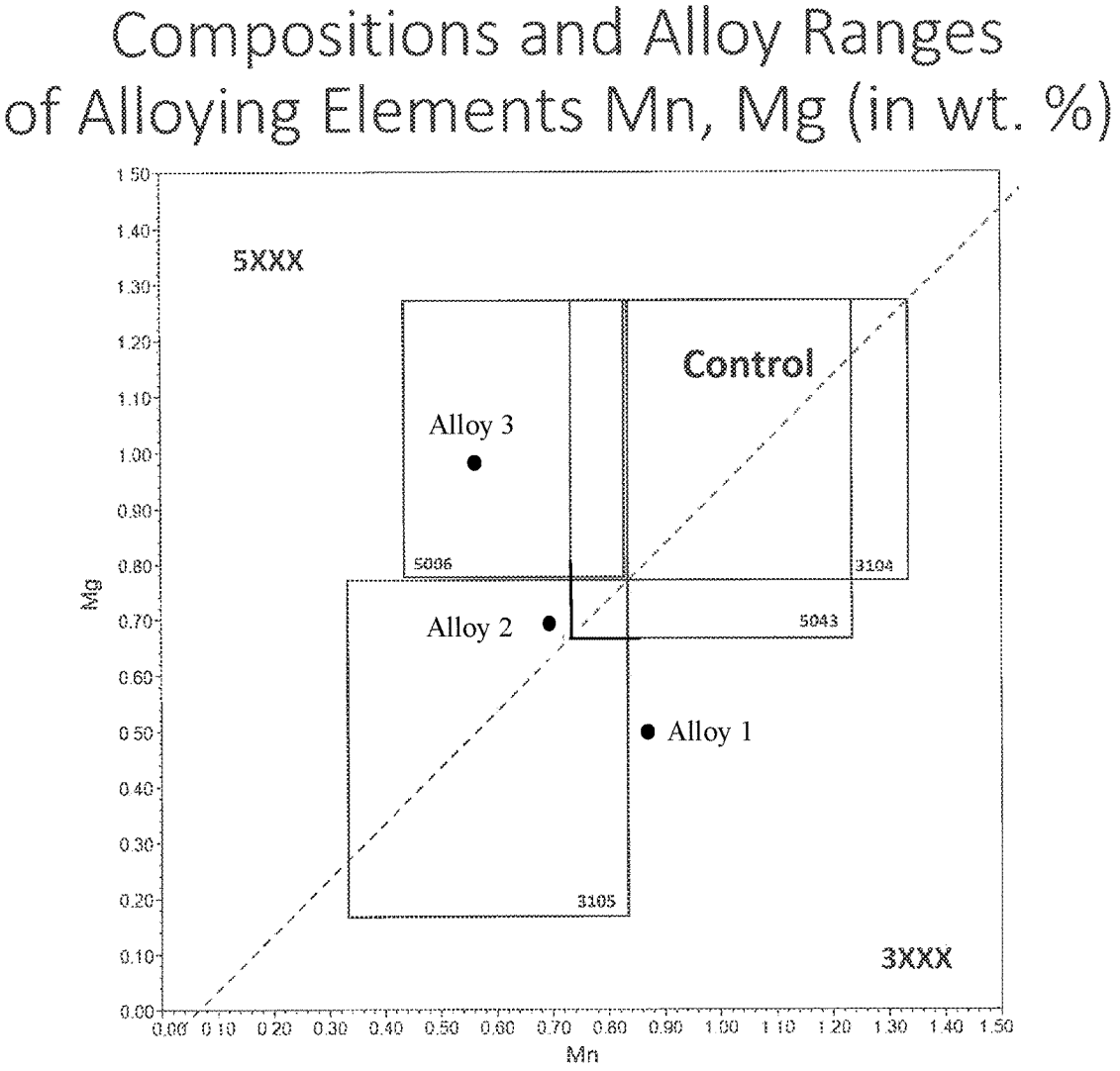
FIG. 4 depicts a graph depicting the compositions of various alloying elements for three alloys and a control alloy evaluated in the Examples section in accordance with some embodiments of the present disclosure.

Alloy 1 is an aluminum alloy sheet having a composition of 0.21 wt. % Si; 0.51 wt. % Fe; 0.16 wt. % Cu; 0.88 wt. % Mn; 0.50 wt. % Mg, and the balance being aluminum. Alloy 2 is an aluminum alloy sheet 0.21 wt. % Si; 0.52 wt. % Fe; 0.15 wt. % Cu; 0.69 wt. % Mn; 0.70 wt. % Mg, the balance being aluminum. Alloy 3 is an aluminum alloy sheet having a composition of 0.2 wt. % Si; 0.53 wt. % Fe; 0.15 wt. % Cu; 0.55 wt. % Mn; 0.9 wt. % Mg, and the balance being aluminum. In some embodiments, the Control Alloy is AA 3104. FIG. 4 depicts a graph depicting the compositions of various alloying elements for three alloys evaluated in the Examples section in accordance with some embodiments of the present disclosure.

It was observed that a lower area % and lower number density dispersoid was achieved with extended preheat practice. Also, in comparing the 17 hour preheat practice images to the 55 hour preheat practice images for certain alloys evaluated, it was observed that the growth of the constituent phase occurred at the expense of the dispersoids. Further, it was observed that there was a small change in dispersoid particle diameter. Finally, it was observed that the extended preheat (55 hours) resulted in a significant reduction in dispersoid f/r for all samples evaluated (e.g. Alloy 1-3 and the Control Alloy).

One method to produce sheet with dispersoid f/r less than 7.65 is to increase preheat practice from standard production targets utilized for can sheet.

Without being bound by a particular mechanism and/or theory, it is believed that as the preheat soak temperature increases, the smallest $Al_{12}Mn_3Si$ dispersoids become thermodynamically unstable and dissolve. The Mn that goes back into solid solution diffuses to larger particles (either constituents or dispersoids, such that big particles grow at the expense of small particles.) Without being bound by a particular mechanism and/or theory, this is believed to result in an increase in the amount of insoluble constituent and a decrease in the amount of dispersoid (i.e. the total amount of these phases stay constant). This process continues with increased preheat soak time and/or increased preheat soak temperature.

In some embodiments, the ingot for the aluminum sheet experiences preheat practice times in the range of: presoak time of 3 hours at 1080° F. plus soak time of 30-40 hours at 1060° F.; or presoak time of 3 hours at 1085° F. plus soak time of 30-40 hours at 1060° F.; or presoak time of 3 hours at 1090° F. plus soak time of 30-40 hours at 1060° F., or presoak time of 3 hours at 1095° F. plus soak time of 30-40 hours at 1060° F.; or presoak time of 3 hours at 1100° F. plus soak time of 30-40 hours at 1060° F. Greater times or temperatures are applicable.

In some embodiments, the ingot for the aluminum sheet experiences preheat practice times in the range of: presoak time of 3 hours at 1080° F. plus soak time of 35-40 hours at 1060° F.; or presoak time of 3 hours at 1085° F. plus soak time of 35-40 hours at 1060° F.; or presoak time of 3 hours at 1090° F. plus soak time of 35-40 hours at 1060° F., or presoak time of 3 hours at 1095° F. plus soak time of 35-40 hours at 1060° F.; or presoak time of 3 hours at 1100° F. plus soak time of 35-40 hours at 1060° F. Greater times or temperatures are applicable.

In some embodiments, the ingot for the aluminum sheet experiences preheat practice times in the range of: presoak time of 3 hours at 1080° F. plus soak time of 37-40 hours at 1060° F. or presoak time of 3 hours at 1085° F. plus soak time of 37-40 hours at 1060° F.; or presoak time of 3 hours at 1090° F. plus soak time of 37-40 hours at 1060° F., or presoak time of 3 hours at 1095° F. plus soak time of 37-40 hours at 1060° F.; or presoak time of 3 hours at 1100° F. plus soak time of 37-40 hours at 1060° F. Greater times or temperatures are applicable.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

We claim:

1. A method, comprising:

obtaining a first aluminum alloy sheet formed from rolling a first ingot of a 3xxx or a 5xxx series aluminum alloy, wherein an amount of Mn in the first aluminum alloy sheet is from 0.45 wt. % to not greater than 0.9 wt. % Mn, wherein an amount of Mg in the first aluminum alloy sheet is from 0.5 wt. % to not greater than 0.9 wt. % Mg, and wherein, prior to rolling, the first ingot has been heated to a sufficient temperature for a sufficient time to achieve a first dispersoid f/r of less than 7.65, wherein the sufficient time is less than 55 hours; and forming a container precursor from the first aluminum alloy sheet.

2. The method of claim 1, wherein the first aluminum alloy sheet has a thickness between 0.006 inches to not greater than 0.07 inches.

3. The method of claim 1, wherein the 3xxx series aluminum alloy is selected from the group consisting of: AA 3x03, AA 3x04 and AA 3x05.

4. The method of claim 1, wherein the 3xxx series aluminum alloy is AA 3104.

5. The method of claim 1, wherein the 5xxx series aluminum alloy is selected from the group consisting of AA 5043 and AA 5006.

6. The method of claim 1, wherein the first dispersoid f/r is between about 4.5 to less than 7.65.

7. The method of claim 1, wherein when the first aluminum alloy sheet is formed into a container precursor, the container precursor has less observed surface striations and ridges as compared to a precursor formed from a second aluminum alloy sheet rolled from a second ingot having a second dispersoid f/r value of 7.65 or greater.

8. The method of claim 1, wherein the dispersoid f/r is the ratio of a second phase divided by the size of the second phase.

9. The method of claim 8, where the second phase is $Al_{12}Mn_3Si$.

10. A method, comprising:

heating a first ingot of 3xxx or 5xxx series aluminum alloy to a sufficient temperature for a sufficient time to achieve a first dispersoid f/r of less than 7.65, wherein the sufficient time is less than 55 hours; and rolling the first ingot into a first aluminum alloy sheet.

11. The method of claim 10, wherein the first aluminum alloy sheet has a thickness between 0.006 inch to not greater than 0.07 inch.

12. The method of claim 10, wherein the 3xxx series aluminum alloy is selected from the group consisting of: AA 3x03, AA 3x04 and AA 3x05.

13. The method of claim 10, wherein the 3xxx series aluminum alloy is AA 3104.

14. The method of claim 10, wherein the 5xxx series aluminum alloy is selected from the group consisting of AA 5043 and AA 5006.

15. The method of claim 10, wherein the first dispersoid f/r is between about 4.5 to less than 7.65.

16. The method of claim 10, wherein an amount of Mn in the first aluminum alloy sheet is from 0.45 wt. % to not greater than 0.9 wt. % Mn.

17. The method of claim 10, wherein an amount of Mg in the first aluminum alloy sheet is from 0.5 wt. % to not greater than 0.9 wt. % Mg.

18. The method of claim 10, wherein when the first aluminum alloy sheet is formed into a container precursor, the container precursor has less observed surface striations and ridges as compared to a container precursor formed from a second aluminum alloy sheet rolled from a second ingot having a second dispersoid f/r value of 7.65 or greater.

19. A method, comprising:

obtaining an aluminum alloy sheet formed from rolling an ingot of a 3xxx or a 5xxx series aluminum alloy, wherein an amount of Mn in the aluminum alloy sheet is from 0.45 wt. % to not greater than 0.9 wt. % Mn, wherein an amount of Mg in the aluminum alloy sheet is from 0.5 wt. % to not greater than 0.9 wt. % Mg, and wherein, prior to rolling, the ingot has been heated to a sufficient temperature for a sufficient time to achieve a dispersoid f/r of less than 7.65, wherein the sufficient time is less than 55 hours; and forming a container from the aluminum alloy sheet, wherein the ingot has the dispersoid f/r of less than 7.65.

20. The method of claim 19, wherein the first aluminum alloy sheet has a thickness between 0.006 inches to not greater than 0.07 inches.

* * * * *